United States Patent [19]

Ballentine

[11] 4,094,297

[45] June 13, 1978

[54] CERAMIC-GLASS BURNER

[76] Inventor: Earle W. Ballentine, 127 Lomita St., El Segundo, Calif. 90245

[21] Appl. No.: 696,793

[22] Filed: Jun. 16, 1976

Related U.S. Application Data

[63] Continuation-in-part of Ser. No. 654,113, Feb. 2, 1976, abandoned, which is a continuation-in-part of Ser. No. 518,473, Oct. 29, 1974, abandoned.

[51] Int. Cl.[2] ..... F24C 3/04

[52] U.S. Cl. ..... 126/39 J; 431/215

[58] Field of Search ..... 126/39 R, 39 J, 299; 431/214, 242, 215; 239/557, 558

[56] References Cited

U.S. PATENT DOCUMENTS

| | | | |
|---|---|---|---|
| 3,285,240 | 11/1966 | Schmidt | 431/215 X |
| 3,525,325 | 8/1970 | Perl | 126/39 J |
| 3,608,505 | 9/1971 | Rosenberg et al. | 126/39 J X |
| 3,698,378 | 10/1972 | Rosenberg et al. | 126/39 J |
| 3,733,027 | 5/1973 | Napier | 126/39 J |
| 3,734,681 | 5/1973 | Perl | 431/242 |
| 3,968,785 | 7/1976 | Perl | 126/39 J |

*Primary Examiner*—Edward G. Favors
*Attorney, Agent, or Firm*—Ralf H. Siegemund

[57] ABSTRACT

A burner for use on a gas range top in which the burner combustion products heat the bottom surface of a ceramic-glass plate. My stoichiometric burners provide optimum performance when they are used to heat surfaces which operate at low temperatures such as a water heater or a steam boiler.

There are, however, other applications wherein the surfaces to be heated must operate at high temperatures such as a broiler for a gas range.

A new principle stoichiometric equation is provided for the spacing of the apertures in the top surface of the burner chamber when the stoichiometric burner is exposed to a thermal radiation field.

A new principle blower for forcing the combustion air through a heat exchanger is now described in U.S. Pat. No. 3,859,009.

22 Claims, 10 Drawing Figures

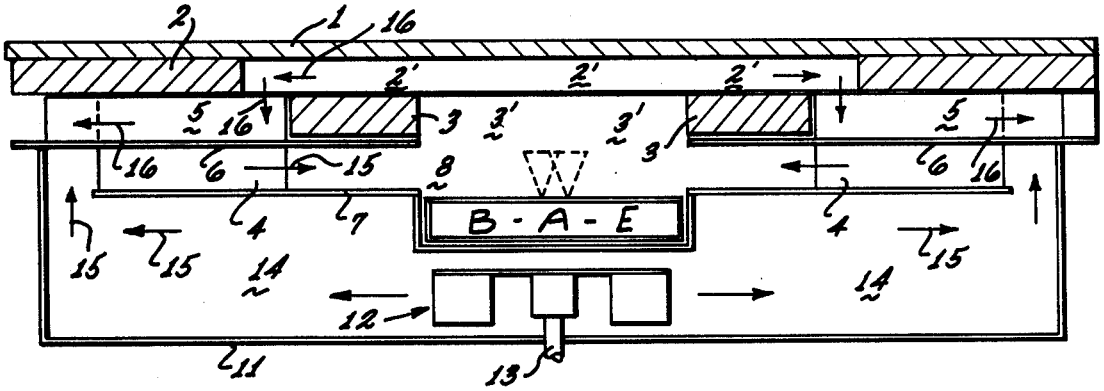
FIG. 1
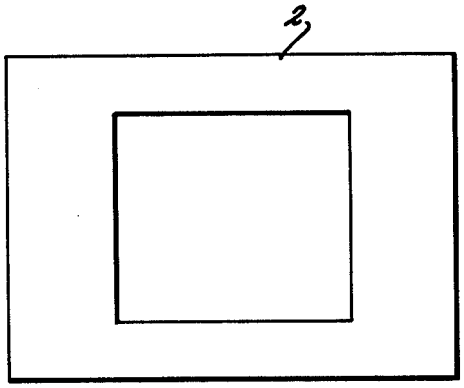
FIG. 2
FIG. 3
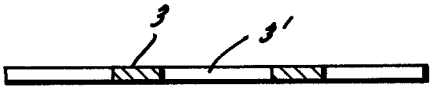
FIG. 4
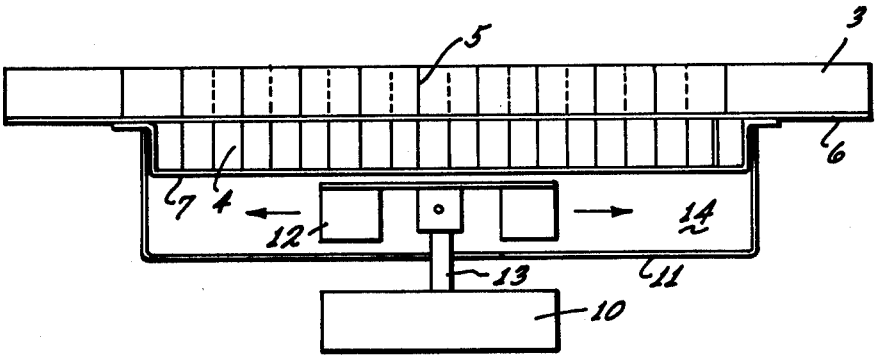

CERAMIC-GLASS BURNER

This is a continuation-in-part of my application Ser. No. 654,113, filed Feb. 2, 1976, which, in turn, is a continuation-in-part of my application Ser. No. 518,473, filed Oct. 29, 1974 the latter two applications having been abandoned.

BACKGROUND OF THE INVENTION

The glass-top electric range has experienced wide market acceptance and is destined to become a larger factor in the gas range market, because the housewife has found that it is very easy to clean. There is also a reduced fire hazard. The sales of gas ranges have decreased in the same ratio as marked penetration of the glass-top range sales.

Stoichiometric burners are described in various configurations in my applications Ser. No. 419,514, filed Nov. 28, 1973 and Ser. No. 687,663, filed May 19, 1976, abandoned but continued in my application Ser. No. 727,578, filed Sep. 28, 1976, and; Ser. No. 687,682, also filed May 19, 1976.

My new stoichiometric burner for operation in a radiation is entitled IMPROVED GAS BURNER, was filed June 16, 1976, Ser. No. 696,792, which is a Continuation in part of an application filed Sep. 5, 1975, Ser. No. 610,562, which in turn is a continuation-in-part of my application Ser. No. 580,544, filed May 27, 1975 the latter, two applications have been abandoned.

A new ceramic glass burner is disclosed also in said continuation-in-part application of the above-identified application, Ser. No. 518,473.

DESCRIPTION OF THE INVENTION

I have discovered that, for example, in radiation field the particular linear spacing of the apertures through which gaseous fuel is discharged in free turbulent jets must be modified if the gas and fuel temperature differ. This is particularly true in ceramic glass burners; therefore, my ceramic-glass burner is an integration of several unique components as follows:

I. A stoichiometric burner constructed as burner-absorber-exchanger in which apertures are arranged in accordance with the following relation:

$$D_s = 2.4 \text{ to } 2.5\ R\ d_o\,[T_{RG}/T_{RA}]$$

where $D_s$ is the stoichiometric aperture spacing $R$ = the air-gas ratio (about 10:1)

$d_o$ = the aperture diameter $T_{RG}$ = the Rankine temperature of the gaseous fuel $T_{RA}$ = the Rankine temperature of the combustion air whereby preferably the apertures are arranged in arrays establishing septor burners. The space above this unit is limited by a ceramic-glass plate which radiates in down direction.

II. The space above the burner's stoichiometric plane of demarcation but below the ceramic-glass plate is the combustion chamber wherein the products of combustion have reached their maximum temperature.

III. The space above the "burner-absorber-exchanger" but below the plane of demarcation is a mixing chamber wherein the combustion air flows through the lower section of the counter-flow recuperator.

IV. The space above the combustion chmaber, but below the ceramic-glass plate, includes another heat exchanger, wherein the products of combustion flow in opposite directions along the bottom surface of the ceramic-glass plate and then flow downward into the upper section of the counterflow recuperator. These combustion products transfer their heat to the fins in the lower section of the counterflow recuperator whereby the combustion air is heated by the fins.

V. The chamber below the counterflow recuperator contains my centrigufal blower which forces the combustion air and subsequently the products of combustion through the lower and upper sections of the two recuperators.

DESCRIPTION OF THE DRAWINGS

While the specification concludes with claims particularly pointing out and distinctly claiming the subject matter which is regarded as the invention, it is believed that the invention, its objects and features, and advantages thereof will be better understood from the following description, which merely illustrates exemplary preferred embodiments of structure which may be utilized to practice the invention, taken in connection with the accompanying drawings, in which:

FIG. 1 is a sectional elevation of the ceramic-glass top burner;

FIG. 2 is a top view of the heat exchange chamber;

FIG. 3 is a sectional view of the element defining the combustion chamber;

FIG. 4 is a sectional side elevation of the ceramic-glass top burner;

Figure 5:
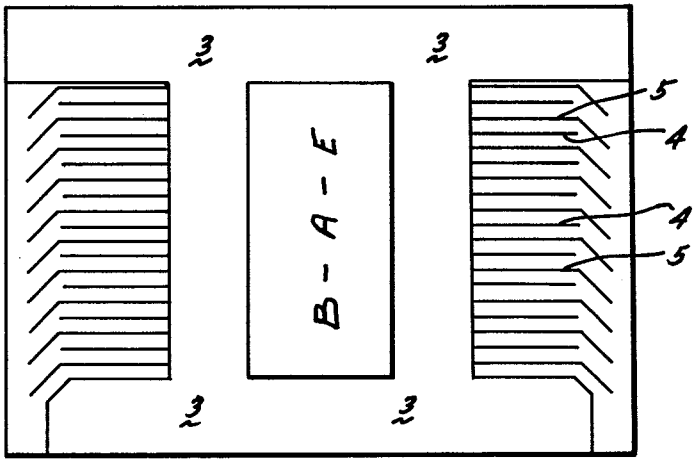
FIG. 5 is a top view of the combustion chamber which also shows the upper section of the counter ow recuperator.

Turning first to FIG. 1, reference numeral 1 is the ceramic-glass plate which has a uniform thickness of about 3/16 inch. 2 is the wall of the heat exchange chamber 2' which also supports the ceramic-glass top plate 1. The wall 2 is cemented to the bottom of the ceramic-glass plate 1, and is shown in detail in FIG. 2. The chamber 2' is supported by an element 3 defining a combustion chamber 3', and is shown in detail in FIGS. 3 and 5. The cumbustion chamber defining element 3 is supported by a plate 6. Plate 6 has an opening which is identical to the bottom opening in FIG. 3. Plate 6 has the same internal peripheral dimensions as the heat exchange chamber 2' as shown in FIG. 2. However, plate 6 also has slots which are identical with fins 4 and fins 5 in FIG. 4. The fins 4 and 5 are supported by a housing 7. The housing 7 also provides a mixing chamber 8 which contains the "burner-absorber-exchanger", as described in FIGS. 6, 7, 8 or 9 and 10, and which I label as B-A-E.

FIG. 4 is a sectional end view of the ceramic-glass top burner. The fins 4 and 5 are positioned in the recuperator cavities as shown in FIGS. 3 and 4. The electric motor 10 is supported by the blower housing 11. The supports are not shown. The blower impeller 12 is mounted on the motor shaft 13. The combustion air enters through the fins 4 of the counterflow recuperator along arrows 15. The combustion products leaving the combustion chamber 2' discharge through the fins 4 and fins 5 of the counterflow recuperator and flow along path 16 to the rear of the range top and then into the room. The combustion air flows radially from the impeller 12 in the plenum 14 as shown by arrows 15. The air enters the fins 4 and flows into the mixing chamber 8, as shown in FIG. 4. The combustion air then flows in the mixing chamber cavity 8 and up into the combustion chamber 3'. The combustion products flow radially out from heat exchange chamber 2' and enter the recuperator fins 4 and 5 as shown by arrows 16. Finally, the combustion products leave the recuperator fins 4 and 5 in 45° change in direction in a quasi-radial flow.

Figure 6:
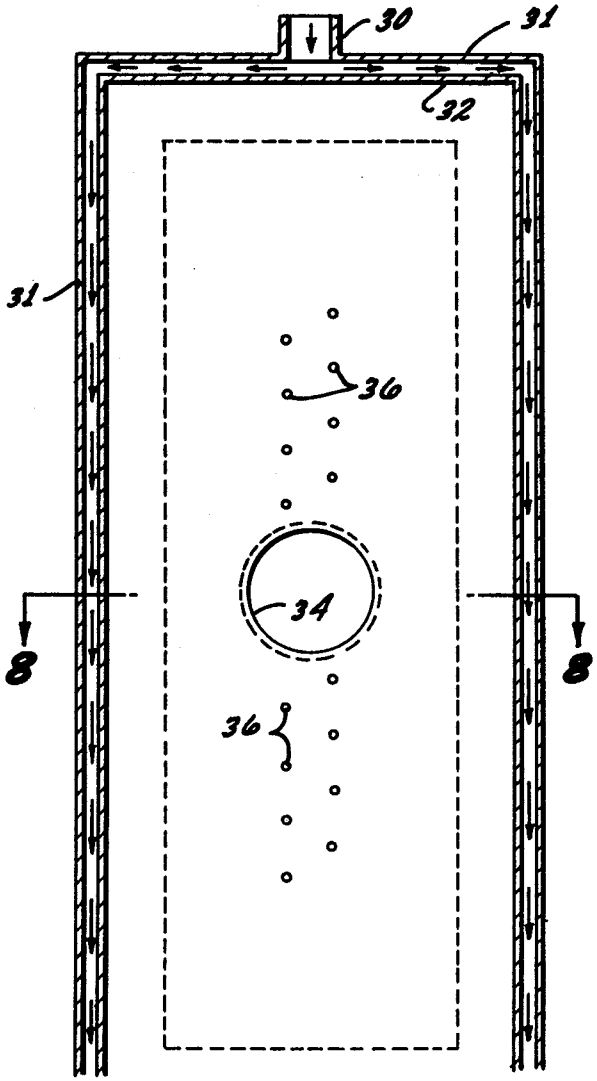
FIG. 6 is a top view of the rectangular "burner-absorber-exchanger"

FIG. 6 is a top view of a first example for a "burner-absorber-exchanger" (B-A-E) which is made entirely of steel.

The gaseous fuel enters coupling 30 and then flows in opposite directions between the outer casing 31 and the exchanger wall 32. The width of the passage between the two walls is 1/16 inches.

The top surface 33 is welded to the outer casing 31. The inner liner 32 is welded to the top surface 33 also. Thus, the gaseuous fuel has a long path in the exchanger passages before it enters the chamber 35 through the aperture 30*a*. The gaseous fuel thus flows along the top surface 33 to the orifices 36 from all directions and is thus further heated by the top surface 33 which absorbs the radiation from the ceramic-glass plate 1. The top surface 33 is also coated with a colloidal graphite which has a high absorptivity. The tube 34 receives the electric igniter which consists of the igniter resistor 39 which is supported by the porcelain ceramic 37, which in turn, is supported by a clamp.

Figure 7:
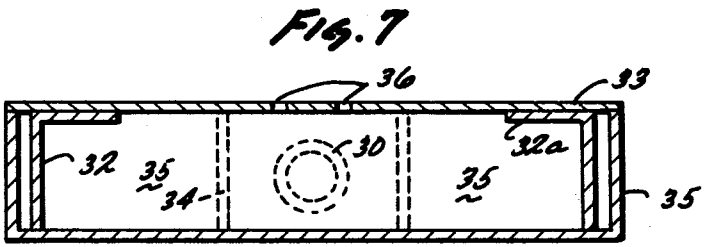
FIG. 7 is a cross-sectional elevation of the "burner-absorber-exchanger"

FIG. 7 is a cross-sectional elevation of the "burner-absorber-exchanger". The exchanger flange 32 is welded to the top surface 33. The exchanger flange 32 has a high temperature and a long path and is most effective in heating the gaseous fuel which flows between the outer casing 31 and exchanger wall 32.

Figure 8:
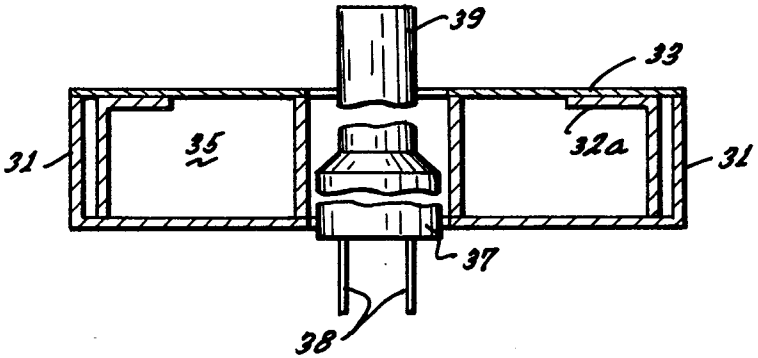
FIG. 8 is a quadrature cross-sectional elevation of the "burner-absorber-exchanger"

FIG. 8 shows a cross-sectional elevation of the "burner-absorber-exchanger". FIG. 8 also shows a cross-sectional elevation of the tube 44 and in addition shows the electric igniter 39, which is positioned partly within the tube 44. The igniter ceramic base 37 is supported by a clamp which is not shown. The spade terminals 38 will fit into the socket which is not shown.

My new "burner-absorber-exchanger" (FIGS. 9 and 10) produces outstanding performance. The gaseous fuel is heated to a temperature of 725° F and the combustion air is heated to a temperature of 550° F. These temperatures determine the Rankine temperature ratio in the formula for the aperture spacing. The heat output of my stoichiometric burner at a gas pressure of 4 inches w.c. is 9500 BTU/hr. initially and then decreased to 6300 BTU/hr. The burner cycled at a rate of 10 seconds off and 20 seconds on. The ceramic plate reached a temperature of 1085° F in 5 minutes and stabilized at a temperature of 1100° F ± 25° F. Since the gaseous fuel flow was two-thirds of the time with a heat output of 6300 BTU/hr., the actual gas consumption would produce a heat output of 4200 BTU/hr. The combustion was perfect with no deposition of carbon on the ceramic plate.

Figure 9:
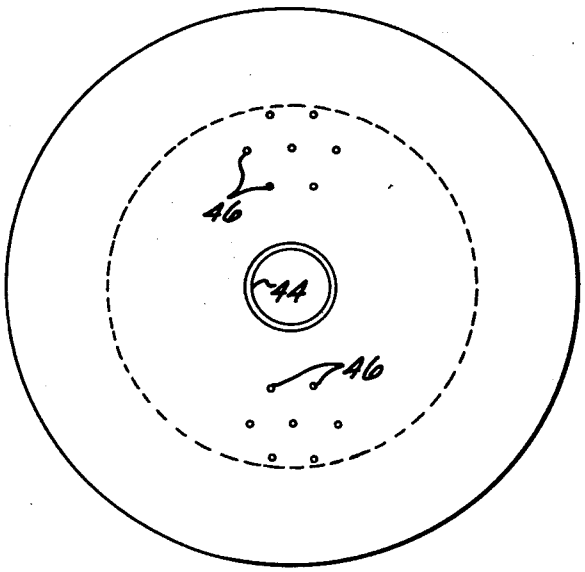
FIG. 9 is a top view of my circular "burner-absorber-exchanger"
Figure 10:
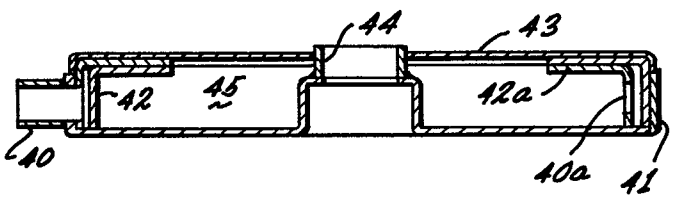
FIG. 10 is a cross-section of my circular "burner-absorber-exchanger".

This new component is shown in FIGS. 9 and 10. Gaseous fuel enters coupling 40 and then flows in opposite directions between the outer casing 41 and the exchanger wall 42. The width of the passage between the two walls in 1/16 inches, and that space defines an annular flow path for the fuel gas.

The top surface 43 is welded to the outer casing 41. The inner liner 42 is welded to the top surface 43 also. Thus, the gaseous fuel has a long path in the exchanger passages before it enters the chamber 45 through the aperture 40*a* which is located opposite inlet 40.

The gaseous fuel thus flows along the top surface 43 to the orifices 46 from all directions and is thus further heated by the top surface 43 which absorbs the radiation from the ceramic-glass plate 1. The top surface 43 is also coated with colloidal graphite which has a high absorptivity. The tube 44 receives the electric igniter which consists of an igniter resistor which is supported by the porcelain ceramic, which in turn, is supported by the clamp.

The unit as shown in FIGS. 9 and 10 constitutes a second example of the above mentioned three combination units A-B-E. The top surface of plate 43 is a vigorous absorber of radiation which is used to preheat the fuel gas as flowing in the annular space between flanges 41 and 42. The two septor burners 46 constituted by seven apertures, spaced as per the rule outlined above, constitute the burner. The flange 42 actually is the prime element of the heat exchanger.

In a typical example, the Rankine temperature of the fuel as so preheated is about 1185 and the Rankine temperature of the combustion air, after having been preheated by the combustion gases, is about 1010, so that $T_{RG}/T_{RA}$ is about 1.173 For a diameter $d_o$ of the apertures 46 of 16/1000 inches, a spacing of $D_s = 0.454$ is the proper value.

Turning now to certain particulars of my construction, the combustion chamber 2 is produced as a single ceramic component which is molded out of fused fibrous potassium aluminum silicate which can operate at 2300° F. The material will henceforth be designated as CERROFORM. The other molded form contains a central rectangular opening which is the mixing chamber and openings at each end which encase the counterflow recuperator fins. Cerroform has an emissivity of 93% of a black body radiator. Thermodynamics requires that the emissivity and absorptivity must be identical at the same termpature. Cerroform has a relatively low thermal conductivity. I have discovered that the heat losses from the combustion chamber can be greatly reduced by spraying molten aluminum on the surfaces of the Cerroform. The absorptivity of aluminum in the temperature range of 440° F to 1070° F is 0.039 to 0.057. Thus, about 94% of the radiation from the ceramic top plate is reflected and therefore contained in the combustion chamber, excluding the radiation from the ceramic top plate which passes through the opening to the mixing chamber.

The ceramic glass material has some very unusual characteristics. I believe that the material is polarized in an electric field during solidification since the lateral thermal conductivity is very low and the normal radiant transmissivity is very high. The emissivity of the material, like most ceramics, is very high. The surface area for cooking which is heated by the burner combustion products is about 56 in.$^2$. Thus, the temperature of the combustion products after leaving the surface to be heated is very high. In order to obtain satisfactory efficiency, it is necessary to transfer a portion of this heat to the combustion air required by the stoichiometric burner. I have found that a form of counterflow recuperator which uses fins which pass through slots in the wall between the combustion products in the wall between the combustion products and the combustion air is quite efficient.

The counterflow recuperator requires a much greater pressure drop than can be produced by burner. The burner head is substantially lost when the burner combustion products impinge normally on the bottom surface of the ceramic top plate. For this reason, I provide a small supplementary blower to force the combustion air and combustion products through the various passages.

The radial flow blower wheel has a high static efficiency and operates without a scroll. Since the blower wheel is in the plenum chamber with the controls, there is a substantial saving in the space required. The radial flow blower impeller discharges air at a uniform velocity in all directions. The prior art blowers with a scroll discharge only in one direction and are quite bulky. The velocity of flow from the scroll exit is very nonuniform with the highest velocity near the cut-off and the lowest velocity at the scroll periphery.

A control system for this burner is disclosed in my copending application Ser. No. 645,112, filed Feb. 2, 1976 now U.S. Pat. No. 3,969,064, the content of which is incorporated by reference in this application.

I claim:

1. A ceramic-glass burner for heating a cooking pan, comprising:

a stoichiometric burner means having particularly spaced apertures for discharging free turbulent jets; a ceramic glass plate above said burner means the linear spacing of these apertures being equal to 2.4 to 2.5 times R $d_o T_{RG}/T_{RA}$ wherein R is the stoichiometric air-to-gas ratio for the fuel gas, $d_o$ is the aperture diameter; means including the glass plate and the burner means for defining a mixing chamber and a combustion chamber between said burner means and said plate;

the free turbulent jets of gaseous fuel being discharged from the stoichiometric burner means into the mixing chamber at the temperature $T_{RG}$ for entraining combustion air entering the mixing chamber for combustion after ignition of the stoichiometric mixture in the combustion chamber above the mixing chamber thereby producing combustion products which have a maximum temperature;

counterflow recuperator means having an upper section and a lower section, the upper section having fins in heat exchange relation with said combustion products so that heat captured by the fins of the upper sections of the counterflow recuperators is transferred to fins of the lower section being disposed in the flow path of the combustion air entering the mixing chamber means, so that the combustion air is preheated to the temperature $T_{RA}$; and means for forcing the combustion air to flow through the lower section of the counterflow recuperator means into the mixing chamber.

2. A burner in accordance with claim 1 said burner means being an integrated unit of a burner-absorber-exchanger means, wherein the burner has a plate having said apertures, the plate absorbing radiation from the ceramic plate and heating gaseous fuel as fed to the burner means and prior to discharge through the apertures.

3. A burner in accordance with claim 2 wherein the burner-absorber-exchanger means is rectangular and employs a paraform-B burner aperture array.

4. A burner in accordance with claim 2 wherein the "burner-absorber-exchanger" means is circular and employs two septor burner aperture arrays.

5. A burner in accordance with claim 1 the mixing and combustion chambers being defined by walls heat exchanger also having walls, said walls being made of fused, fibrous potassium silicate which can operate at 2300° F and which have a relatively low thermal conductivity.

6. A burner in accordance with claim 5 wherein the walls are coated with molten aluminum.

7. A device in accordance with claim 2 wherein the top surface of the plate of the "burner-absorber-exchanger" is coated with colloidal graphite in order to increase the absorptivity of the radiation emitted by the ceramic glass plate.

8. A burner in accordance with claim 1 wherein a combined static and gravitational pressure head as produced by said stoichiometric burner means is supplemented by a velocity pressure head produced by a blower means, forcing the combustion air through said lower section.

9. A device for heating a cooking pan supported by a ceramic-glass plate comprising:

an integrated combination of three distinctly different entities disposed underneath said plate, these entities being a stoichiometric burner means; a radiation absorber means; and a heat exchanger means, being respectively designated B, A, and E, the space above the three entities being a mixing chamber, the space below the ceramic plate being a combustion chamber, the two chambers being separated by a demarcation plane;

said stoichiometric burner means B providing for operation in a radiation field and having apertures whereby the aperture spacing is defined by the following equation:

$$D_s = 2.4 \text{ to } 2.5\ R\ d_o\,[T_{RG}/T_{RA}]$$

where $D_s$ = the aperture spacing $R$ = the air-gas ratio $d_o$ = the aperture diameter $T_{RG}$ = the Rankine temperature of the gaseous fuel, and $T_{RA}$ = the Rankine temperature of the combustion air;

said radiation absorber means A being the planar top surface of the stoichiometric burner means and containing the apertures, said heat exchanger means E, including a long narrow path whereby the gaseous fuel is heated to said temperature $T_{RG}$; and blower means for forcing air into the mixing chamber, the air entering the mixing chamber having a temperature $T_{RA}$ below $T_{RG}$ so that the ratio $T_{RG}/T_{RA}$ is larger than unity.

10. A device in accordance with claim 9, including a counterflow recuperator means having an upper and lower section and wherein the combustion products from the burner means flow through the upper section of the counterflow recuperator means and wherein the combustion air flows through the lower section of the counterflow recuperator means to be heated therein to said temperature $T_{RA}$.

11. A device in accordance with claim 10 and said blower means being a centrifugal impeller means for forcing said air needed for combustion through the lower section of the counterflow recuperator means into the jets of gaseous fuel emanating from the apertures in the planar top surface of said stoichiometric burner means.

12. A device in accordance with claim 11, wherein the centrifugal impeller means is driven by an electric motor means positioned external to the plenum chamber means, whereby the static pressure produced by the centrifugal impeller means supplements the static pressure produced by the stoichiometric burner means.

13. A device in accordance with claim 11, wherein the combustion products produced above the said stoichiometric demarcation plane are also forced through the upper section of the conterflow recuperator means by said centrifugal impeller means.

14. A device in accordance with claim 9, said planar top surface being made of iron with a colloidal graphite coating.

15. A gas burner comprising:

means defining a first chamber having a flat top and an inlet for fuel gas, the fuel gas flowing in contact with an inside wall of the flat top preheating the fuel gas to a Rankine temperature $T_{RG}$;

aperture means in the flat top arranged in at least one array wherein linear spacing of the apertures in the array is equal to 2.4 to 2.5 times $R \cdot do \cdot T_{RG}/T_{RA}$, wherein R is an air gas ratio of the fuel gas for sustaining combustion, do is the aperture diameter and $T_{RA}$ is the Rankine temperature of combustion air;

a ceramic glass plate above the first chamber means, and heating said flat top by radiation;

means including the first chamber means and the ceramic glass plate to define a mixing chamber above the flat top, and a combustion chamber above the mixing chamber but underneath the ceramic glass plate;

a heat exchanger having a first section and a second section and constructed for heat transfer from the first section to the second section, the first section being in communication with the combustion chamber for receiving heated combustion products therefrom, said second section for receiving ambient air, preheating it and discharging the preheated air into said mixing chamber, and at said temperature $T_{RA}$.

16. A gas burner as in claim 15, said aperture means being comprised of two arrays of apertures, the array being spaced-apart by a distance larger than said spacing.

17. A gas burner as in claim 16, wherein each array has seven apertures arranged in a hexagon.

18. A gas burner as in claim 16, wherein each array has two rows of apertures.

19. A gas burner as in claim 15, and including blower means for forcing air into and through the second section.

20. A ceramic glass burner for heating a working pan, comprising:

a stoichiometric burner; a ceramic glass plate disposed above said burner; wall means disposed in relation to the plate and the burner to define a lower mixing chamber above the burner, and a combustion chamber above the mixing chamber underneath the plate, the wall means being made of fused fibrous potassium silicate;

counterflow recuperator means having an upper section with fins disposed in heat exchange relation with combustion products flowing from said combustion chamber, and having a low section with fins being in heat conductive relation with the fins of the upper section, the fins of the lower section being disposed in a flow path for air flowing into the mixing chamber for preheating the air prior to combustion.

21. A ceramic glass burner as is claim 20 said wall means being coated with molten aluminum.

22. A ceramic glass burner as in claim 20, said burner having a top surface coated with colloidal graphite.

* * * * *